US006897813B2

(12) United States Patent
Higasa

(10) Patent No.: US 6,897,813 B2
(45) Date of Patent: May 24, 2005

(54) COMBINED ANTENNA WITH ANTENNA COMBINING CIRCULARLY POLARIZED WAVE ANTENNA AND VERTICAL ANTENNA

(75) Inventor: Masahiko Higasa, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/844,142

(22) Filed: May 12, 2004

(65) Prior Publication Data

US 2004/0227670 A1 Nov. 18, 2004

(30) Foreign Application Priority Data

May 16, 2003 (JP) ..... 2003-139000

(51) Int. Cl.[7] ..... H01Q 1/38; H01Q 1/48; H01Q 13/12

(52) U.S. Cl. ..... 343/700 MS; 343/846; 343/769

(58) Field of Search ..... 343/700 MS, 769, 343/893, 846, 848, 765; H01Q 1/38, 13/12, 1/48

(56) References Cited

U.S. PATENT DOCUMENTS 5,006,859 A * 4/1991 Wong et al. ..... 343/700 MS
5,220,335 A 6/1993 Huang ..... 343/700 MS
6,124,829 A * 9/2000 Iwasaki ..... 343/700 MS
6,184,828 B1 * 2/2001 Shoki ..... 342/372

FOREIGN PATENT DOCUMENTS

| | | |
|---|---|---|
| EP | 1 077 505 | 2/2001 |
| JP | 10-107542 | 4/1998 |
| JP | 11-122036 | 4/1999 |
| WO | WO 96/35241 | 11/1996 |

* cited by examiner

*Primary Examiner*—Trinh Vo Dinh
(74) *Attorney, Agent, or Firm*—Brinks Hofer Gilson & Lione

(57) ABSTRACT

A combined antenna combining a circularly polarized wave antenna and a vertically polarized wave antenna is provided. A flat plate antenna for ground waves is fixed on a printed board, and a two-point feeding type patch antenna is placed and fixed on a metallic flat plate of the plate antenna. The plate antenna has one feed terminal and six uniformly spaced ground terminals. The patch antenna has two feed pins at equidistant positions from the center of the patch electrode along radial lines that form a right angle. Each of feed pins is connected to a 90-degree phase difference circuit using an opening of the plate antenna. The relative position between the flat plate and the patch electrode is the same along the peripheral direction. All of the feed terminals, the ground terminals and the feed pins have a predetermined positional relationship relative to one another.

2 Claims, 3 Drawing Sheets

COMBINED ANTENNA WITH ANTENNA COMBINING CIRCULARLY POLARIZED WAVE ANTENNA AND VERTICAL ANTENNA

This application claims the benefit of priority to Japanese Patent Application No. 2003-139000, herein incorporated by reference.

BACKGROUND OF THE INVENTION

1. Field of the Invention

The present invention relates to a combined antenna mounted on a movable body such as an automobile and capable of receiving satellite waves and ground waves.

2. Description of the Related Art

Circularly polarized waves are widely used in systems for receiving satellite broadcasts on a movable body such as an automobile, and in recent years, in order to improve reception in a blind zone such as in the shadow of a building, the use of a satellite broadcast system has been considered to retransmit from the stationary satellite the same contents as the direct broadcast waves. As for the antenna suitable for such a satellite broadcast system, a combined antenna has been suggested having a combined structure including a patch antenna for receiving satellite waves and a helical antenna (or rod antenna) for receiving ground waves on the same printed board in the related art (See Japanese Unexamined Patent Application Publication No. 10-107542, third page and FIG. 1 thereof). This combined antenna may receive circularly polarized satellite waves by means of the patch antenna facing the ceiling and receive vertically polarized ground waves without disturbing the satellite waves propagating to the patch antenna by means of the helical antenna (or rod antenna) installed with its axial direction inclined to the vertical.

In the above-mentioned conventional combined antenna, the helical antenna (or rod antenna) for receiving ground waves should be formed to have a long length, which causes it to be unsuitable for a small and thin antenna necessary for a movable body such as an automobile. Furthermore, the circularly polarized antenna for satellite waves and the vertically polarized antenna for ground waves of the combined antenna are installed very close together on a printed board to implement the compact size thereof, so that directivity of one antenna is apt to be changed in the region near the other antenna due to the electromagnetic coupling between the circularly polarized antenna and the vertically polarized antenna, which also causes receiving sensitivity to be degraded in a specific direction.

SUMMARY OF THE INVENTION

The present invention has been achieved with consideration of the above conventional situation, and its object is to provide a combined antenna combining a circularly polarized wave antenna and a vertically polarized wave antenna, which is suitable for miniaturization and has a high reliability.

In order to achieve the above object, one aspect of the present invention is to provide a combined antenna, comprising: a flat plate antenna, for allowing a circular or polygonal metallic flat plate that has an opening at the center thereof to face a ground conductor by a predetermined interval and allowing the metallic flat plate to be connected to the ground conductor through six ground terminals uniformly spaced along the peripheral edge of the opening as well as to a feed line through a feed terminal; a patch antenna, which has a dielectric substrate having a patch electrode on a upper surface and a ground electrode on a lower surface, respectively, placed and fixed on the metallic flat plate through an insulating member, for allowing a first feed pin and a second feed pin penetrating the dielectric substrate to be connected to the patch electrode at two positions equidistant from the center of the patch electrode along radial lines that form a right angle while allowing the two feed pins to be connected to a 90-degree phase difference circuit through the opening; and a printed board having the ground conductor formed on its upper surface and having a plurality of pass-through holes for allowing the ground terminals, the feed terminal, and the feed pins to be inserted and fixed to the pass-through holes, respectively, wherein the feed terminal is located along an extended line connecting the center of the flat plate antenna to the first feed pin, and any two of the adjacent ground terminals are symmetrically placed with the extended line as an axis of symmetry while any one of the ground terminals is located along an extended line connecting the center of the flat plate antenna to the second feed pin, and wherein the flat plate antenna is excited to radiate a vertically polarized wave while the patch antenna is excited to radiate a circularly polarized wave.

In the combined antenna having the above antenna, when the flat plate antenna is excited in a transverse magnetic mode (TM01 mode) that has the lowest resonant frequency, a vertically polarized wave that is approximately omnidirectional radiates around within a plane parallel to the metallic flat plate, so that the flat plate antenna may act as a vertically polarized antenna for ground waves. In addition, when the patch antenna is excited in a TM11 mode, a circularly polarized wave radiates upward, so that the patch antenna may act as a circularly polarized antenna for satellite waves. By means of the stacked structure that mounts and fixes the patch antenna for satellite waves onto the flat plate antenna for ground waves and connects feed pins of the patch antenna to a feed circuit through the opening of the flat plate antenna, the combined antenna may have a reduced height to thereby reduce the vertical size, which leads to more compact antenna unit. In addition, the process of connecting the feed terminal, the ground terminals, or the feed pins to lands may be performed at the lower surface of the printed board, and the metallic flat plate or the dielectric substrate may be held in a stable position by the terminals fixed on the printed board.

In addition, according to the combined antenna, the patch antenna employs a two-point feeding method while the two feed pins, the feed terminal and the ground terminals of the flat plate antenna have a predetermined positional relationship with one another, so that the inefficiency of the directivity due to the electromagnetic coupling between the patch antenna and the flat plate antenna may be avoided within the azimuth surface. That is, the patch antenna that employs a two-point feeding method rather than a one-point feeding method may have a more uniform directivity within the azimuth surface, and the flat plate antenna may have an increased gain along the diameter which includes the feed terminal, so that two ground terminals are symmetrically placed in a position that takes the diameter direction for the axis of symmetry while one ground terminal is placed near one feed pin so as to also increase the gain along the diameter perpendicular to the above-mentioned diameter direction, which allows the flat plate antenna to have a more uniform directivity within the azimuth surface. Thus, the combined antenna can achieve stable performance resulting from a reduced variation of the receiving sensitivity with respect to the azimuth, whether receiving the satellite waves (circularly polarized waves) or the ground waves (vertically polarized waves).

In the combined antenna having the above construction, when all of the ground terminals and the feed terminal of the flat plate antenna are made of bent pieces to extend to the printed board from the metallic flat plate, the metallic flat plate, the ground terminals, and the feed terminal may be simply formed by press punching and bending a single metal plate, which also preferably allows the mechanical strength of the flat plate antenna to be significantly increased.

DESCRIPTION OF THE PREFERRED EMBODIMENT

Figure 1:
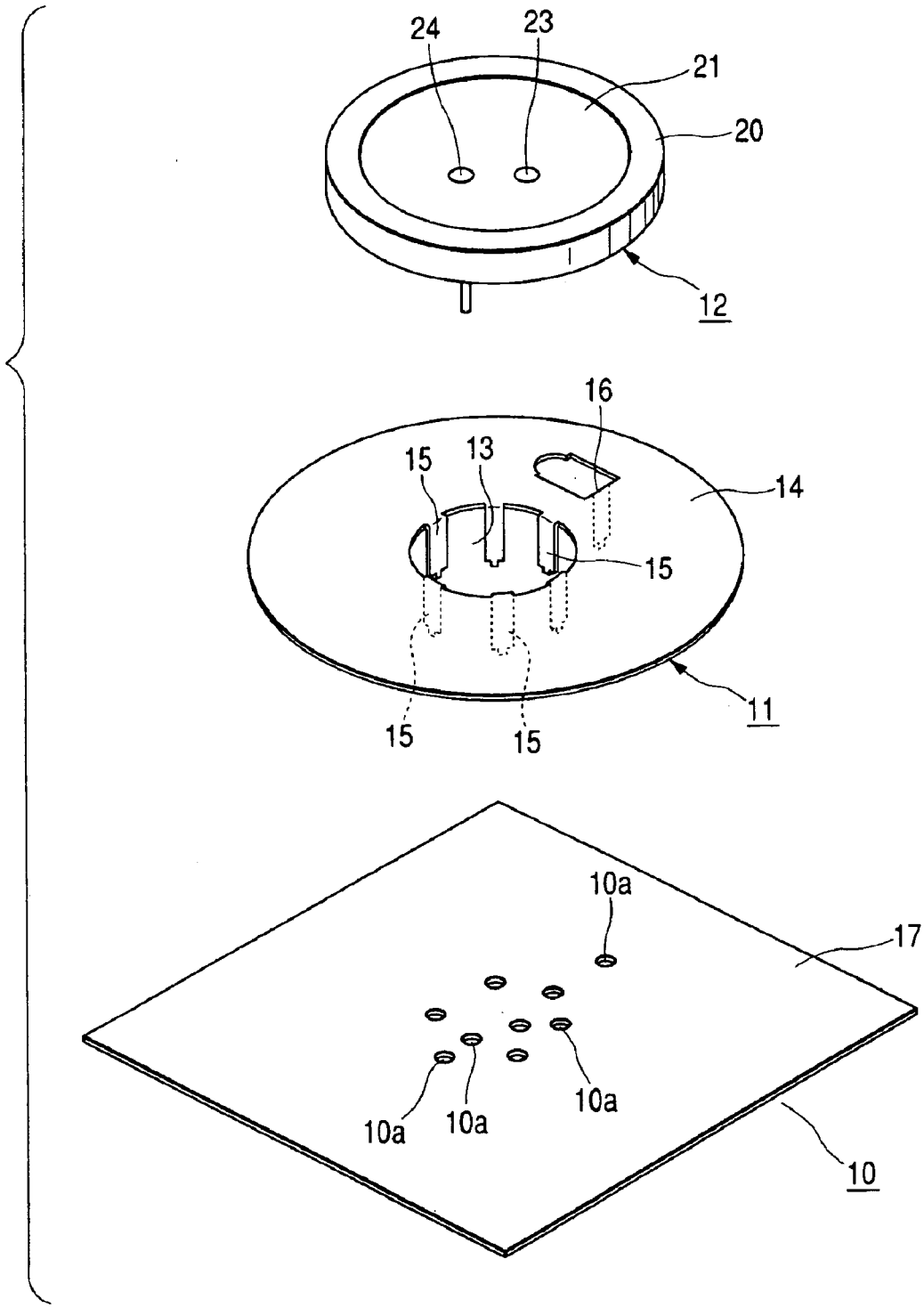
FIG. 1 is an exploded perspective view of a combined antenna according to one embodiment of the present invention.
Figure 2:
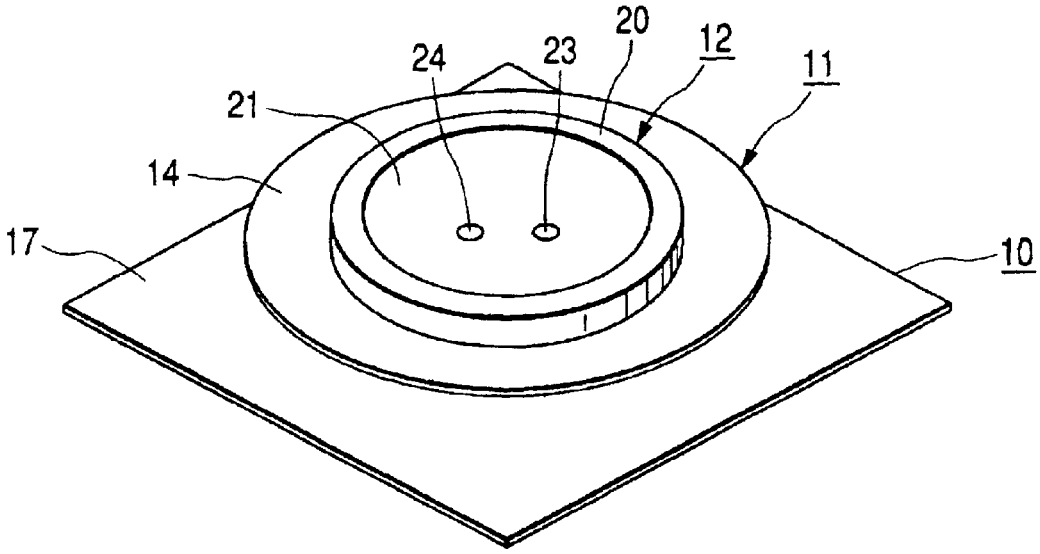
FIG. 2 is a perspective view of the combined antenna.
Figure 3:
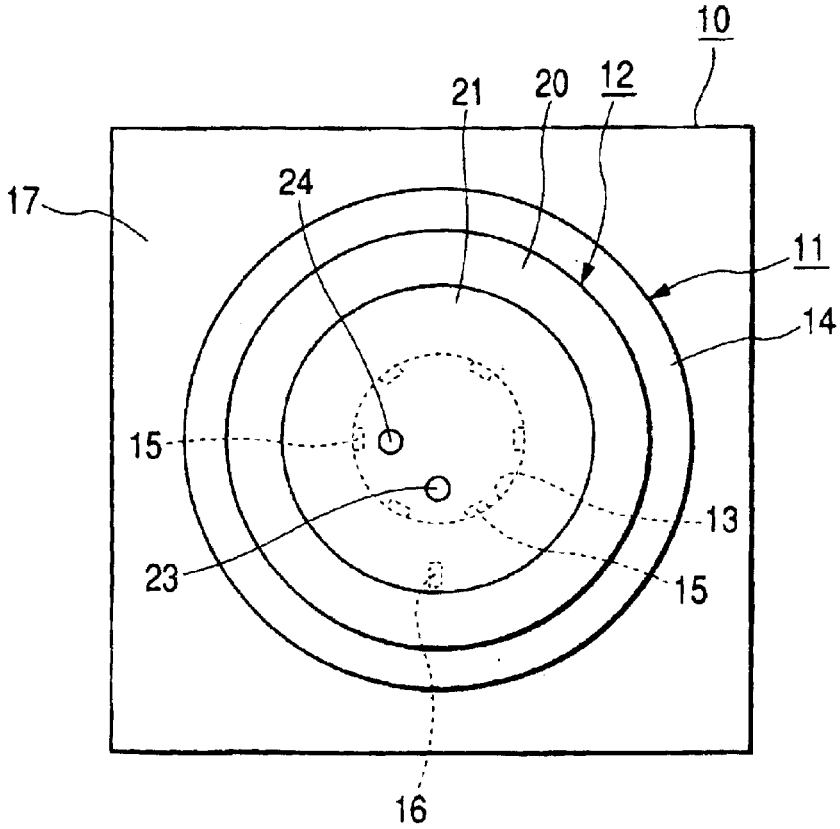
FIG. 3 is a top plan view of the combined antenna.
Figure 4:
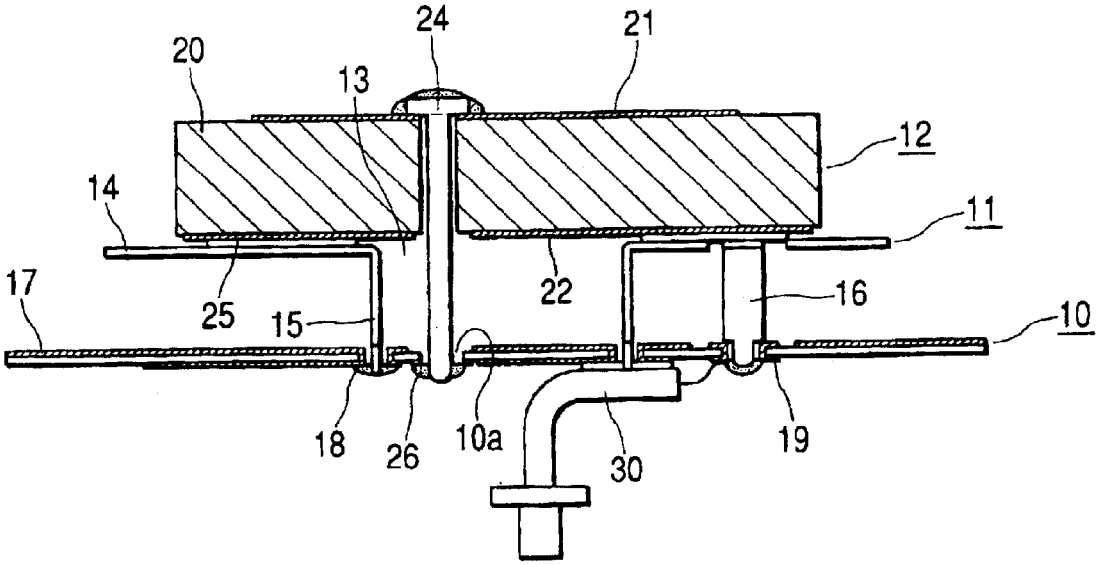
FIG. 4 is a sectional view of the combined antenna.

Hereinafter, an embodiment of the present invention will be described with drawings, wherein FIG. 1 is a exploded perspective view of a combined antenna according to one embodiment of the present invention, FIG. 2 is a perspective view of the combined antenna, FIG. 3 is a top plan view of the combined antenna, and FIG. 4 is a sectional view of the combined antenna.

The combined antenna shown in the drawings comprises a printed board 10 having a plurality of pass-through holes 10*a*, a flat plate antenna 11 for ground waves held on the printed board 10, and a patch antenna 12 for satellite waves held on the flat plate antenna 11.

The flat plate antenna 11 generally includes an annular metallic flat plate 14 having an opening 13 in its center, six ground terminals 15 bent downward from the inner periphery of the metallic flat plate 14, one feed terminal 16 cut up and bent downward from some portion of the metallic flat plate 14, and a ground conductor 17, such as a copper foil, formed almost on the upper surface of the printed board 10, and is constructed to feed a radio frequency signal to the feed terminal 16.

Each of the ground terminals 15 and the feed terminal 16 are formed by press punching and bending the metallic flat plate 14, and all of the terminals 15, 16, and the metallic flat plate 14 are formed from only one metallic plate. Six ground terminals 15 are uniformly spaced, and each of the ground terminals 15 and the feed terminal 16 are formed with the same length as each other. At the lower surface of the printed board 10 as shown in FIG. 4, lands 18 to which the lower end of each of the ground terminals 15 through the pass-through hole 10*a* is soldered, and lands 19 to which the lower end of the feed terminal 16 through the other pass-through hole 10*a* is soldered are provided. The land 18 is electrically connected to the ground conductor 17 on the upper face of the printed board 10, and a feed line (internal conductive member) of a coaxial cable 30 is soldered to the land 19. As such, the terminals 15 and 16 are fixed on the printed board 10, so that the metallic flat plate 14 is securely held on the printed board 10 in a stable position with a constant interval between the metallic flat plate 14 and the ground conductor 17. In addition, the position where the feed terminal 16 is formed within the metallic flat plate 14 is determined selecting a suitable position where impedance therebetween is matched.

When the flat plate antenna 11 having the above construction is excited in a TM01 mode, which has the lowest value of resonant frequency, the antenna radiates approximately omnidirectional, vertically polarized waves to the periphery in the plane parallel to the metallic flat plate 14, so that it may act as the vertically polarized antenna for ground waves, with no significant variation of the receiving sensitivity with respect to the azimuth. Although the metallic flat plate 14 in the flat plate antenna 11 is shaped to be circular, it may be alternatively shaped a regular polygon while maintaining most of the omnidirectional properties of the flat plate antenna 11.

The patch antenna 12 employs a two-point feeding method, which generally comprises a disc-shaped dielectric substrate 20, a circular patch electrode 21 provided on the upper surface of the dielectric substrate 20, a ground electrode 22 provided almost on the entire lower surface of the dielectric substrate 20, and two feed pins 23 and 24 soldered to the patch electrode 21 and that penetrates the dielectric substrate 20 and the opening 13, and is designed to feed a predetermined radio frequency signal to the feed pins 23 and 24 through a 90-degree phase difference circuit (not Shown) formed on the printed board 10.

The dielectric substrate 20 is concentrically placed on the metallic flat plate 14 of the flat plate antenna 11, and the lower surface of the dielectric substrate 20 is adhered to the metallic flat plate 14 with an insulating double-sided tape 25 as shown in FIG. 4. The patch electrode 21 is a radiation element of a microstrip structure, and two feed pins 23 and 24 are soldered to the patch electrode 21 at feed points which are located an equal distance from the center of the patch electrode along radial lines that form a right angle. In other words, two feed pins 23 and 24 are connected to the patch electrode 21 at the position corresponding to both ends of the hypotenuse of the right-angled isosceles triangle where the center of the patch electrode 21 is an apex. In this case, the positions of the feeds point where the feed pins 23 and 24 are connected to the patch electrode 21 is an inner peripheral portion of the patch electrode 21, which is above the opening 13 of the flat plate antenna 11 as shown in FIG. 3. Thus, the feed pins 23 and 24 which extends downward from each feed point are not contacted with the metallic fiat plate 14 or the terminals 15 and 16 but instead pass through the opening 13, and lower ends of each of the feed pins 23 and 24 are soldered to the land 26 of the 90-degree phase difference circuit on the lower surface of the printed board 10 through pass-through holes 10*a* corresponding to the feed pins, respectively.

The patch antenna 12 having the above construction may be excited in two orthogonal modes which have a 90-degree phase difference from each other. When the patch antenna 12 is excited in the TM11 mode, it may radiate the circularly polarized wave upward, so that it may act as a circularly polarized antenna for satellite waves. In addition, the patch antenna 12 employs a two-point feeding method, so that it may have more uniform directivity within an azimuth surface (i.e. the plane parallel to the dielectric substrate 20) as compared to the one-point feeding method.

In the meantime, two feed pins 23 and 24 of the patch antenna 12 are installed within the opening 13 of the flat plate antenna 11, so that the influence from the electromagnetic coupling between the ground terminals 15 of the flat plate antenna 11 formed at the peripheral edge of the opening 13 and the feed pins 23 and 24 needs to be considered. In addition, even if influence of the patch antenna 12 is excluded, the flat plate antenna 11 has a property that allows gain to be readily increased along the diameter that includes the feed terminal 16. Thus, the combined antenna allows the two feed pins 23 and 24 of the patch antenna 12, the ground terminals 15 of the flat plate antenna 11, and the feed terminal 16 to have a predetermined positional relationship one another, which mitigates the inefficiency caused by directional variations in sensitivity within the azimuth surface of the flat plate antenna 11 (i.e., the plane parallel to the metallic flat plate 14).

In other words, in the combined antenna according to the present embodiment, the feed terminal 16 of the flat plate antenna 11 is located along the extended line connecting the feed pin 23 to the center of the flat plate antenna 11 as shown in FIG. 3, and two adjacent ground terminals 15 are symmetrically located along the extended line with said extended line as an axis of symmetry, while the other ground terminal 15 is located along the extended line connecting the other feed pin 24 to the center of the flat plate antenna 11, so that the feed pin 24 and the ground terminal 15 are closely placed. In addition, the above-mentioned setting may be suitably implemented when the number of the ground terminals 15 of the flat plate antenna 11 is six. Also, the feed pins 23 and 24, the ground terminals 15, and the feed terminal 16 are placed to have positional relationship relative to one another, which allows the flat plate antenna 11 to have a reduced gain along diameter which includes the feed terminal 16, and also to have an increased gain along the diameter perpendicular to the above-mentioned diameter direction (i.e. a direction including the feed pins 24), so that the directivity becomes uniform within the azimuth surface.

In the combined antenna according to the above-mentioned embodiment as described above, ground waves may be received by the flat plate antenna 11 and satellite waves may be received by the patch antenna 12, and the patch antenna 12 is stacked on the flat plate antenna 11, so that the whole combined antenna can be more compacter and thinner. Therefore, this combined antenna is suitable for a small antenna for vehicle capable of receiving either ground waves or satellite waves. In addition, according to the combined antenna, the relative positional relationship between the metallic flat plate 14 and the patch electrode 21 is the same along the peripheral direction thereof, and the feed pins 23 and 24, the ground terminals 15, and the feed terminal 16 are set to have a relative positional relationship to one another to improve the directivity change due to the electromagnetic coupling or the like, and the patch antenna 12 employs a two-point feeding method, so that sensitivity is more uniform directionally within the azimuth surface to thereby have a stable performance and a reduced variation of the receiving sensitivity with respect to the azimuth.

Furthermore, in the flat plate antenna 11 employed in the combined antenna, the metallic flat plate 14, each of the ground terminals 15, and the feed terminal 16 may be formed by press punching and bending with only one metal plate, so that it may be fabricated at a low cost resulting from reduced numbers of components and processes for fabricating the same, and assembly accuracy and mechanical strength can be readily secured. Therefore, the metallic flat plate 14 or the dielectric substrate 20 can be supported in a stable position by the terminals 15 and 16 fixed to the printed board 10, which lead to a combined antenna with low cost and high reliability. In addition, the process of connecting the ground terminals 15, the feed terminal 16, or the feed pins 23 and 24 to lands 18, 19, 26, respectively can be simply performed at the lower surface of the printed board 10.

In addition, in the above-mentioned embodiment, the combined antenna is preferably covered with a radar dome (i.e., radome, not shown) when it is mounted on a movable body such as an automobile. That is, when the combined antenna is covered with the radome made of dielectric material, it may not be adversely affected and may be protected from dust or foreign object damage, which allows the combined antenna to have a long service life.

Furthermore, in the above-mentioned embodiment, the metallic flat plate 14 of the flat plate antenna 11, the ground terminals 15, and the feed terminal 16 are formed from one metal plate, however, the ground terminals 15 or the feed terminal 16 may be formed from metal pins independently from the metallic flat plate 14.

The present invention is implemented as the above-mentioned description, and has the following effects.

The patch antenna, which is a circularly polarized antenna satellite waves, is placed and fixed on the metallic flat plate of the flat plate antenna that is a vertically polarized antenna ground waves, and the feed pins of the patch antenna is connected to the feed circuit by means of the opening in the flat plate antenna, so that the combined antenna may receive ground and circularly polarized waves and the volume thereof may be reduced and thinner, and in particular may be suitable for use on the vehicle. In addition, the patch antenna employs a two-point feeding method while the metallic flat plate of the flat plate antenna and the patch electrode of the patch antenna have an approximate relative positional relationship among each other along the peripheral direction thereof, and the feed terminal of the flat plate antenna, ground terminals, and the feed pins of the patch antenna are arranged to have a predetermined relative positional relationship to one another, which improves the directivity change due to the electromagnetic coupling or the like, so that the combined antenna may have less inefficiency due to directionality within the azimuth surface, which also allows the combined antenna to have stable performance and a reduced variation of the receiving sensitivity with respect to the azimuth.

What is claimed is:

1. A combined antenna, comprising: a flat plate antenna for allowing a circular or polygonal metallic flat plate that has an opening at a center thereof to face a ground conductor by a predetermined interval and allowing the metallic flat plate to be connected to the ground conductor through ground terminals uniformly spaced along a peripheral edge of the opening as well as to a feed line through a feed terminal;

a patch antenna, which has a dielectric substrate having a patch electrode on an upper surface and a ground electrode on a lower surface, respectively, placed and fixed on the metallic flat plate through an insulating member, for allowing a first feed pin and a second feed pin penetrating the dielectric substrate to be connected to the patch electrode at two positions equidistant from a center of the patch electrode along radial lines that form a right angle while allowing the first and second feed pins to be connected to a 90-degree phase difference circuit through the opening; and a printed board having the ground conductor formed on an upper surface and having a plurality of pass-through holes for allowing the ground terminals, the feed terminal, and the feed pins to be inserted and fixed to the pass-through holes, respectively, wherein the feed terminal is an extended line connecting the center of the flat plate antenna to first feed pin, and any two of the adjacent ground terminals are symmetrically placed with the extended line as an axis of symmetry while any one of the ground terminals is located along an extended line connecting the center of the flat plate antenna to the second feed pin, and wherein the flat plate antenna is excited to radiate a vertically polarized wave while the patch antenna is excited to radiate a circularly polarized wave.

2. The combined antenna according to claim 1, wherein all of the ground terminals and the feed terminal are made of bent pieces to extend toward the printed board from the metallic flat plate.

* * * * *

UNITED STATES PATENT AND TRADEMARK OFFICE

CERTIFICATE OF CORRECTION

PATENT NO. : 6,897,813 B2
DATED : May 24, 2005
INVENTOR(S) : Masahiko Higasa

It is certified that error appears in the above-identified patent and that said Letters Patent is hereby corrected as shown below:

Column 6,
Line 64, after "feed terminal is" insert -- located along --.
Line 65, after "antenna to" insert -- the --.

Signed and Sealed this

Fifteenth Day of November, 2005

JON W. DUDAS
*Director of the United States Patent and Trademark Office*